US011121497B2

(12) United States Patent
Nagasaka et al.

(10) Patent No.: US 11,121,497 B2
(45) Date of Patent: Sep. 14, 2021

(54) CONNECTOR

(71) Applicant: Yazaki Corporation, Tokyo (JP)

(72) Inventors: Naokazu Nagasaka, Shizuoka (JP); Shoichi Watai, Shizuoka (JP); Akihiro Tsuruta, Shizuoka (JP); Masanobu Oishi, Shizuoka (JP); Naoki Okamoto, Shizuoka (JP); Nobuyuki Sakamoto, Shizuoka (JP); Yoshihito Masuko, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/069,871

(22) Filed: Oct. 14, 2020

(65) Prior Publication Data

US 2021/0119370 A1 Apr. 22, 2021

(30) Foreign Application Priority Data

Oct. 16, 2019 (JP) ..... JP2019-189369

(51) Int. Cl.
*H01R 13/506* (2006.01)
*H01R 13/52* (2006.01)
*H01R 13/627* (2006.01)

(52) U.S. Cl.
CPC ..... *H01R 13/506* (2013.01); *H01R 13/5213* (2013.01); *H01R 13/6272* (2013.01)

(58) Field of Classification Search
CPC ..... H01R 13/506; H01R 13/5213; H01R 13/6272; H01R 13/635
See application file for complete search history.

(56) References Cited

U.S. PATENT DOCUMENTS

| | | | | |
|---|---|---|---|---|
| 5,876,244 | A | 3/1999 | Tabata | |
| 10,637,194 | B1 * | 4/2020 | Kim | H01R 13/6272 |
| 2006/0234535 | A1 * | 10/2006 | Ohtaka | H01R 13/6272 439/157 |
| 2006/0270258 | A1 * | 11/2006 | Ohtaka | H01R 13/62938 439/157 |

(Continued)

FOREIGN PATENT DOCUMENTS

| | | | |
|---|---|---|---|
| JP | 2005-347082 | A | 12/2005 |
| JP | 2012-094289 | A | 5/2012 |
| JP | 2017-216047 | A | 12/2017 |

*Primary Examiner* — Tho D Ta
(74) *Attorney, Agent, or Firm* — Kenealy Vaidya LLP

(57) ABSTRACT

A connector includes: a housing; and a cover. The housing includes a lock body that is lockable to a counterpart lock body so that fitting connection with the counterpart housing is not canceled, and a lock cancellation arm that deforms with application of lock cancellation force to a point-of-effort part and cancels a state in which the lock body is lockable to the counterpart lock body. The cover includes a second wall that covers the housing up to the position of the point-of-effort part in the fitting connection direction, an exposure part formed at the wall to expose the point-of-effort part, and a lock cancellation operation body that includes an operation part capable of receiving a press movement operation, blocks the exposure part to an extent that deformation along with the press movement operation is possible, and applies the lock cancellation force to the point-of-effort part through the deformation.

6 Claims, 9 Drawing Sheets

(56) References Cited

U.S. PATENT DOCUMENTS

| | | | | |
|---|---|---|---|---|
| 2007/0184692 | A1* | 8/2007 | Ohtaka | H01R 13/639<br>439/157 |
| 2018/0212360 | A1 | 7/2018 | Motohashi | |
| 2019/0097354 | A1* | 3/2019 | Zheng | H01R 13/6272 |
| 2019/0103704 | A1* | 4/2019 | Kawashima | H01R 13/6272 |
| 2019/0288444 | A1 | 9/2019 | Sugimoto et al. | |

* cited by examiner

CONNECTOR

CROSS-REFERENCE TO RELATED APPLICATION(S)

The present application claims priority to and incorporates by reference the entire contents of Japanese Patent Application No. 2019-189369 filed in Japan on Oct. 16, 2019.

BACKGROUND OF THE INVENTION

1. Field of the Invention

The present invention relates to a connector.

2. Description of the Related Art

A conventionally known connector includes a housing in which a terminal clasp is stored and a cover that covers the housing from outside. A conductive component (for example, an electrical wire or flexible printed circuit substrate (FPC)) electrically connected with the terminal clasp is connected with the connector and extended outside. The cover is provided to protect the terminal clasp and the conductive component. Such connectors are disclosed in, for example, Japanese Patent Application Laid-open No. 2005-347082, Japanese Patent Application Laid-open No. 2012-94289, and Japanese Patent Application Laid-open No. 2017-216047.

A housing of a connector is fitted and connected to a counterpart housing of a counterpart connector. To achieve this, a holding structure for holding the fitting connection state is provided between the housing and the counterpart housing. The holding structure locks a lock body of the housing and a counterpart lock body of the counterpart housing so that the fitting connection state is not canceled. In the holding structure, a lock cancellation arm that is elastically deformable and can cancel a state in which the lock body and the counterpart lock body are lockable is provided to the housing or the counterpart housing. The lock cancellation arm includes an operation part for canceling the state in which the lock body and the counterpart lock body are lockable. When the lock cancellation arm is provided to the housing, the operation part is potentially covered and hidden by a cover. Thus, in the connector, the operation part of the lock cancellation arm needs to be exposed by, for example, providing a cutout to the cover. However, the cutout of the cover also exposes the housing side, and thus has room for improvement on a waterproof property.

SUMMARY OF THE INVENTION

Thus, the present invention is intended to provide a connector that can reduce degradation of a waterproof property.

In order to solve the above mentioned problem and achieve the object, a connector according to one aspect of the present invention includes a terminal clasp; a housing that stores the terminal clasp and that is fitted and connected to a counterpart housing of a counterpart connector in a fitting connection direction; and a cover that covers, from outside, at least part of the housing and a conductive part protruding from the housing, wherein the housing includes a lock body that is lockable to a counterpart lock body of the counterpart housing so that fitting connection with the counterpart housing is not canceled, and a lock cancellation arm that deforms with application of lock cancellation force on a point-of-effort part and cancels a state in which the lock body is lockable to the counterpart lock body, and the cover includes a wall that covers the housing up to a position of the point-of-effort part in the fitting connection direction, an exposure part formed at the wall to expose the point-of-effort part, and a lock cancellation operation body that is elastically deformable, includes an operation part capable of receiving a press movement operation, blocks the exposure part to an extent that deformation along with the press movement operation is possible, and applies the lock cancellation force to the point-of-effort part through deformation along with the press movement operation.

According to another aspect of the present invention, in the connector, it is preferable that the housing includes therein a virtual plane aligned with the fitting connection direction and orthogonal to a direction in which the lock cancellation force is applied, and the operation part is formed in a tilt shape in which the shortest distance between the virtual plane and a point positioned on the operation part along the fitting connection direction increases as the point moves further in the fitting connection direction.

According to still another aspect of the present invention, in the connector, it is preferable that the cover includes a shielding body that covers a gap between the lock cancellation operation body and the periphery of the exposure part from the operation part side.

According to still another aspect of the present invention, in the connector, it is preferable that the housing includes therein a virtual plane aligned with the fitting connection direction and orthogonal to a direction in which the lock cancellation force is applied, the operation part is formed in a tilt shape in which the shortest distance between the virtual plane and a point positioned on the operation part along the fitting connection direction increases as the point moves further in the fitting connection direction, the cover includes a shielding body that covers a gap between the lock cancellation operation body and the exposure part from the operation part side, and the shielding body has a first outer wall surface tilted in a direction same as a direction in which the operation part is tilted.

According to still another aspect of the present invention, in the connector, it is preferable that the shielding body has a second outer wall surface tilted toward the operation part from the first outer wall surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a connector according to the present invention will be described below in detail with reference to the accompanying drawings. The present embodiment does not limit the present invention.

Embodiment

One embodiment of the connector according to the present invention will be described below based on FIGS. 1 to 9.

Figure 1:
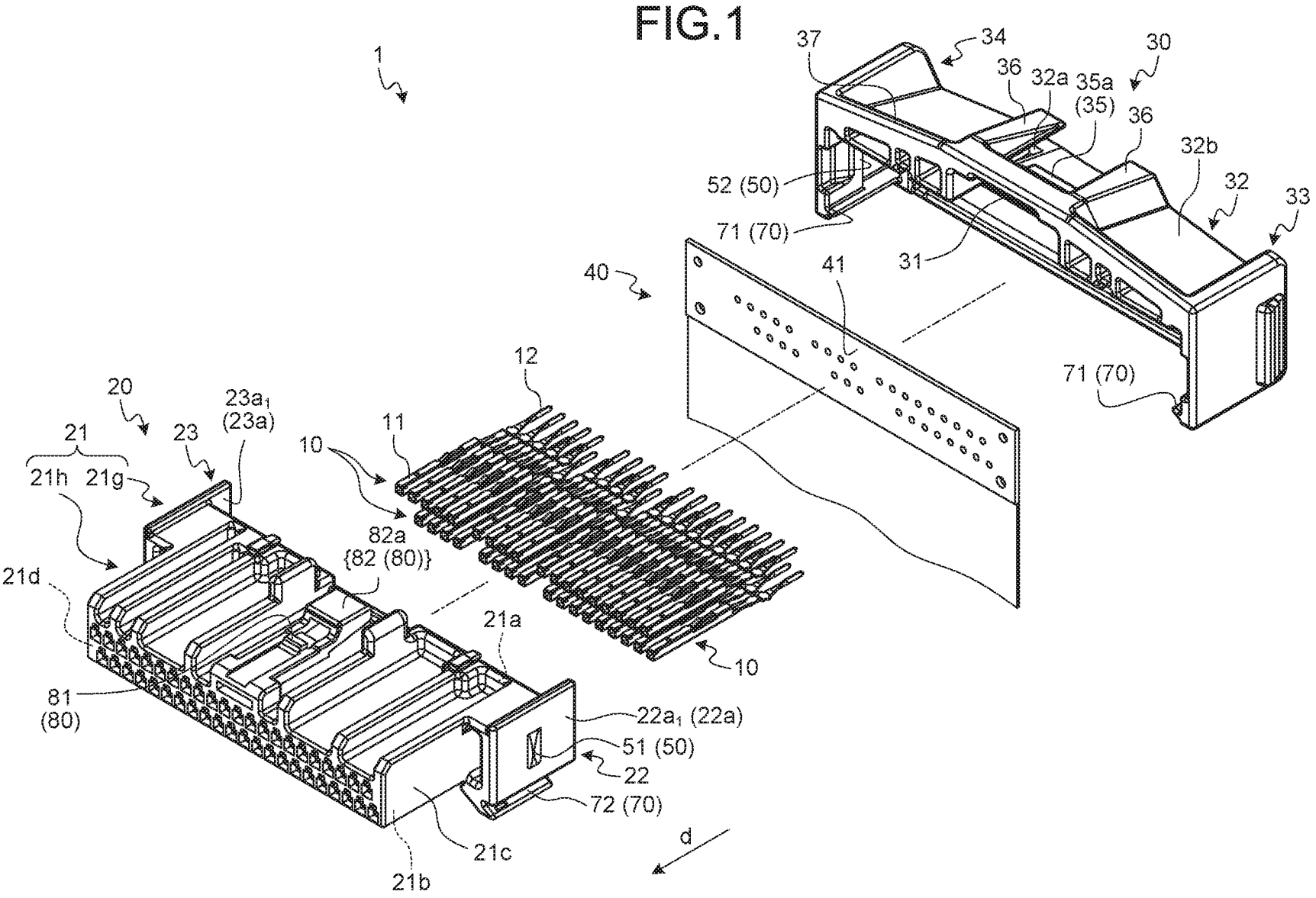
FIG. 1 is an exploded perspective view illustrating a connector of an embodiment.
Figure 2:
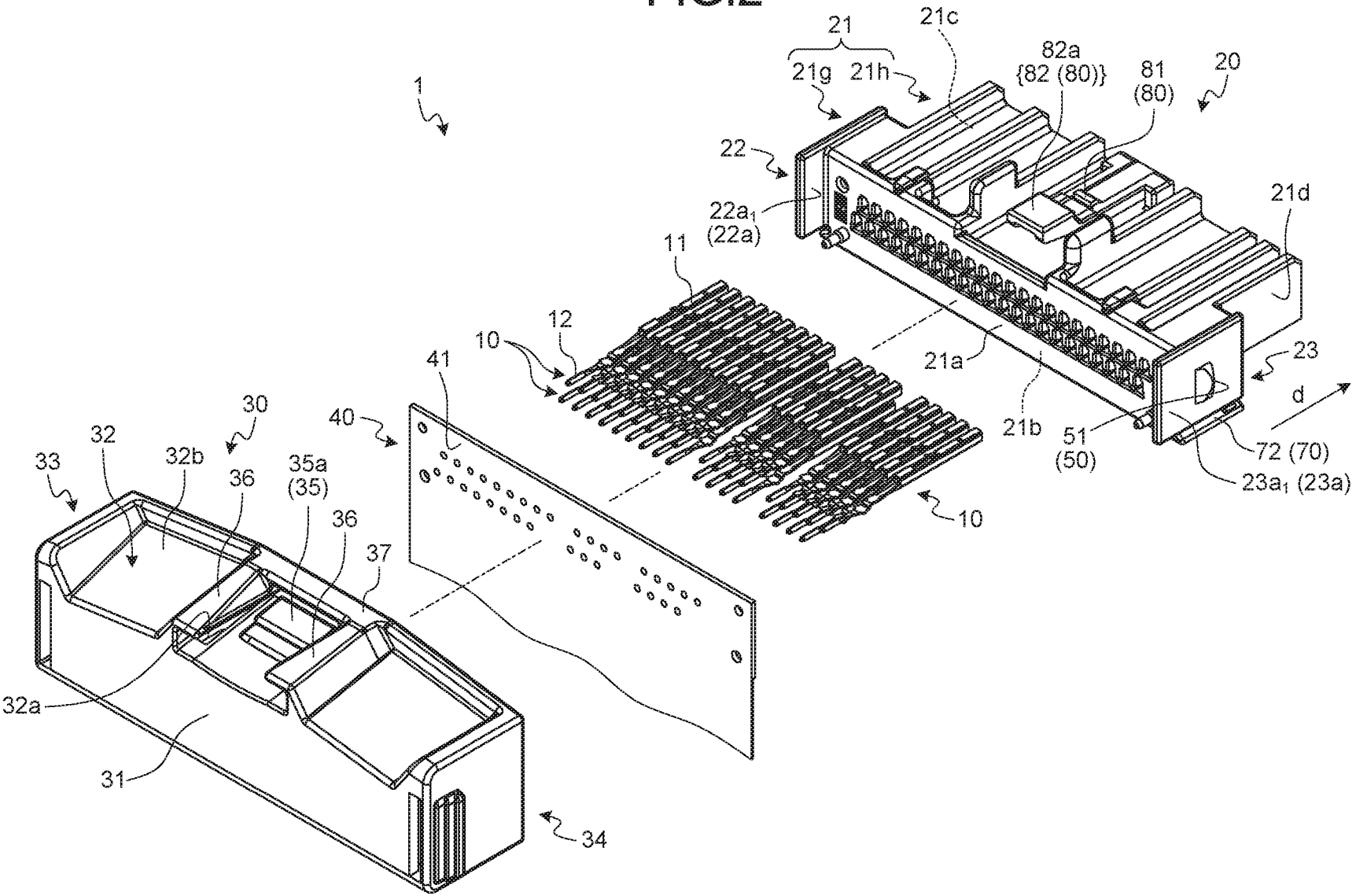
FIG. 2 is an exploded perspective view of the connector of the embodiment when viewed at a different angle.

Reference sign 1 in FIGS. 1 to 7 denotes the connector of the present embodiment. This connector 1 includes a terminal clasp 10, a housing 20 in which the terminal clasp 10 is stored and that is fitted and connected to a counterpart housing (not illustrated) of a counterpart connector in a fitting connection direction d (FIGS. 1 to 5), and a cover 30 that is connected with the housing 20 through insertion and covers, from outside, at least part of the housing 20 and a conductive part (to be described later) protruding from the housing 20 (FIGS. 1 and 2).

The terminal clasp 10 is formed of a conductive material such as metal. For example, the terminal clasp 10 is formed of a metal plate as a parent material through press fabrication such as bending and cutting. The terminal clasp 10 includes a terminal connection part 11 that is physically and electrically connected with a counterpart terminal clasp (not illustrated) of the counterpart connector, and an electrical connection part 12 that is physically and electrically connected with a conductive component 40 (FIGS. 1 and 2). The terminal connection part 11 is formed in, for example, a female terminal shape or a male terminal shape.

The conductive component 40 is, for example, an electrical wire having a terminal connected with the electrical connection part 12 inside a housing body 21, or a flexible flat conductive component disposed outside the housing body 21 and connected with the electrical connection part 12 protruding out of the housing body 21. The flexible flat conductive component is a sheet conductive component in which a conductor and an insulator that are flexible (in other words, plastic) are stacked and formed in a flat plane. For example, the flexible flat conductive component includes a plurality of conductors each forming a circuit pattern. The flexible flat conductive component is, for example, a flexible printed circuit substrate (FPC), a printing circuit structure such as a membrane wiring plate, a flat cable (FC), or a flexible flat cable (FFC).

The connector 1 of the present embodiment includes one or a plurality of terminal clasps 10. The connector 1 of this example includes a plurality of terminal clasps 10, and the electrical connection part 12 of each terminal clasp 10 is physically and electrically connected with a rectangular flexible flat conductive component as the conductive component 40. In this example, each conductor (not illustrated) of the conductive component 40 is provided with one terminal clasp 10. The electrical connection part 12 of the terminal clasp 10 is provided perpendicular to the flat plane of the conductive component 40 by inserting the electrical connection part 12 into a through-hole of the conductive component 40 and soldering the electrical connection part 12 to the conductor exposed at the through-hole. In the conductive component 40 of this example, the terminal clasps 10 are connected at one (side 41) of the four sides of the conductive component 40 (FIGS. 1 and 2), and accordingly, the electrical connection parts of the conductors are disposed at the side 41.

The housing 20 is formed of an insulating material such as synthesis resin. The housing 20 of this example includes the housing body 21 in which the terminal clasps 10 are stored (FIGS. 1 to 6). Each terminal clasp 10 is inserted into the housing body 21 in the fitting connection direction d from the terminal connection part 11 side. In this example, the housing body 21 is formed in a rectangular parallelepiped shape. The terminal connection part 11 of each terminal clasp 10 is stored inside the housing body 21, and the electrical connection part 12 of each terminal clasp 10 protrudes outward through one (first outer wall surface 21*a* (FIGS. 1 to 3)) of the six outer wall surfaces. In this example, the electrical connection part 12 protrudes toward a first wall 31 (to be described later) of the cover 30 in a direction opposite to the fitting connection direction d. Outside the housing body 21, each electrical connection part 12 is soldered to the electrical connection part of the corresponding conductor of the conductive component 40. With the side 41 being disposed opposite to the first outer wall surface 21*a*, the conductive component 40 extends on a second outer wall surface 21*b* side of the housing body 21, which is disposed orthogonal to the first outer wall surface 21*a* (FIGS. 1 to 4).

Figure 3:
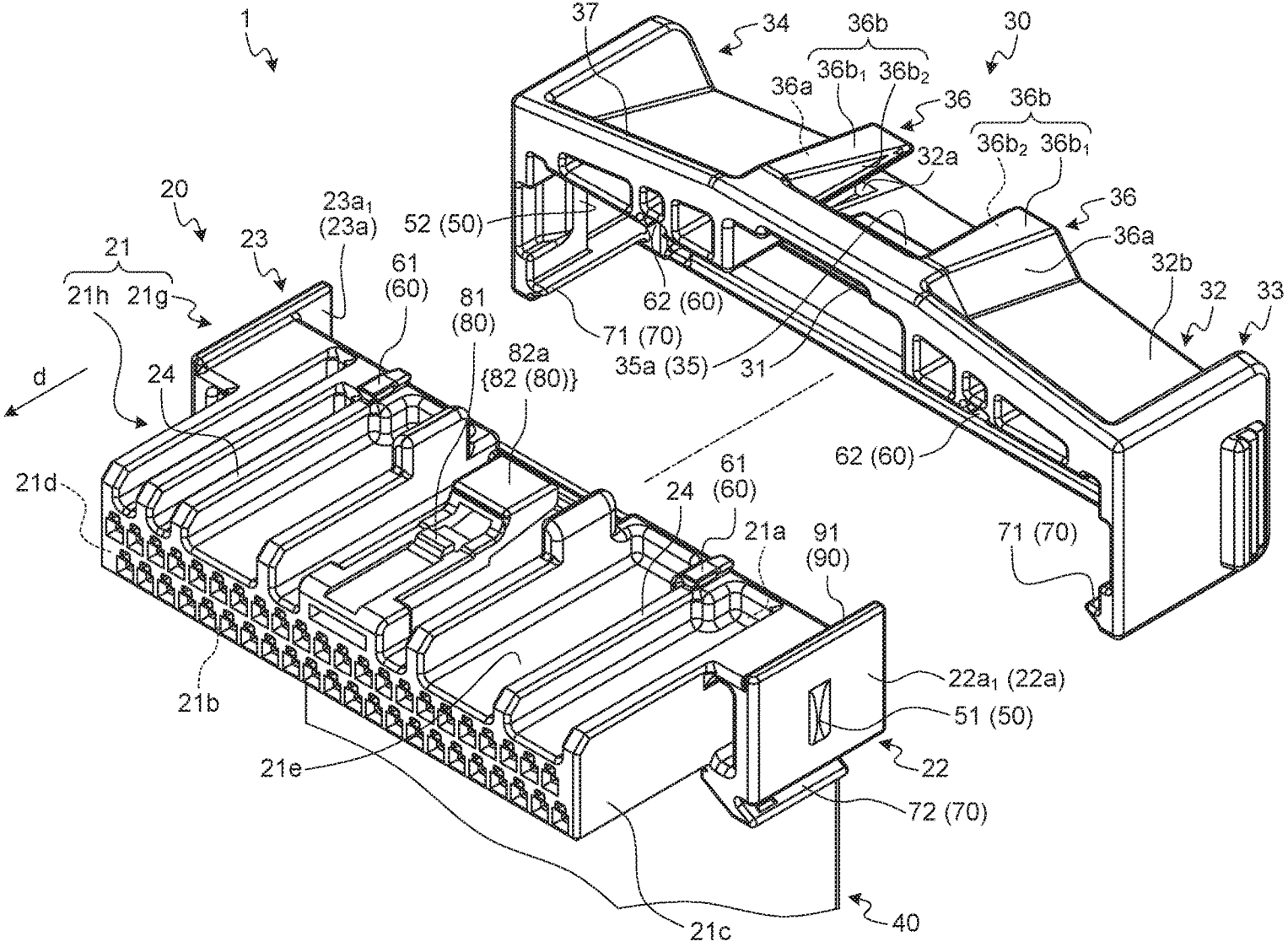
FIG. 3 is an exploded perspective view of the connector before cover connection.
Figure 4:
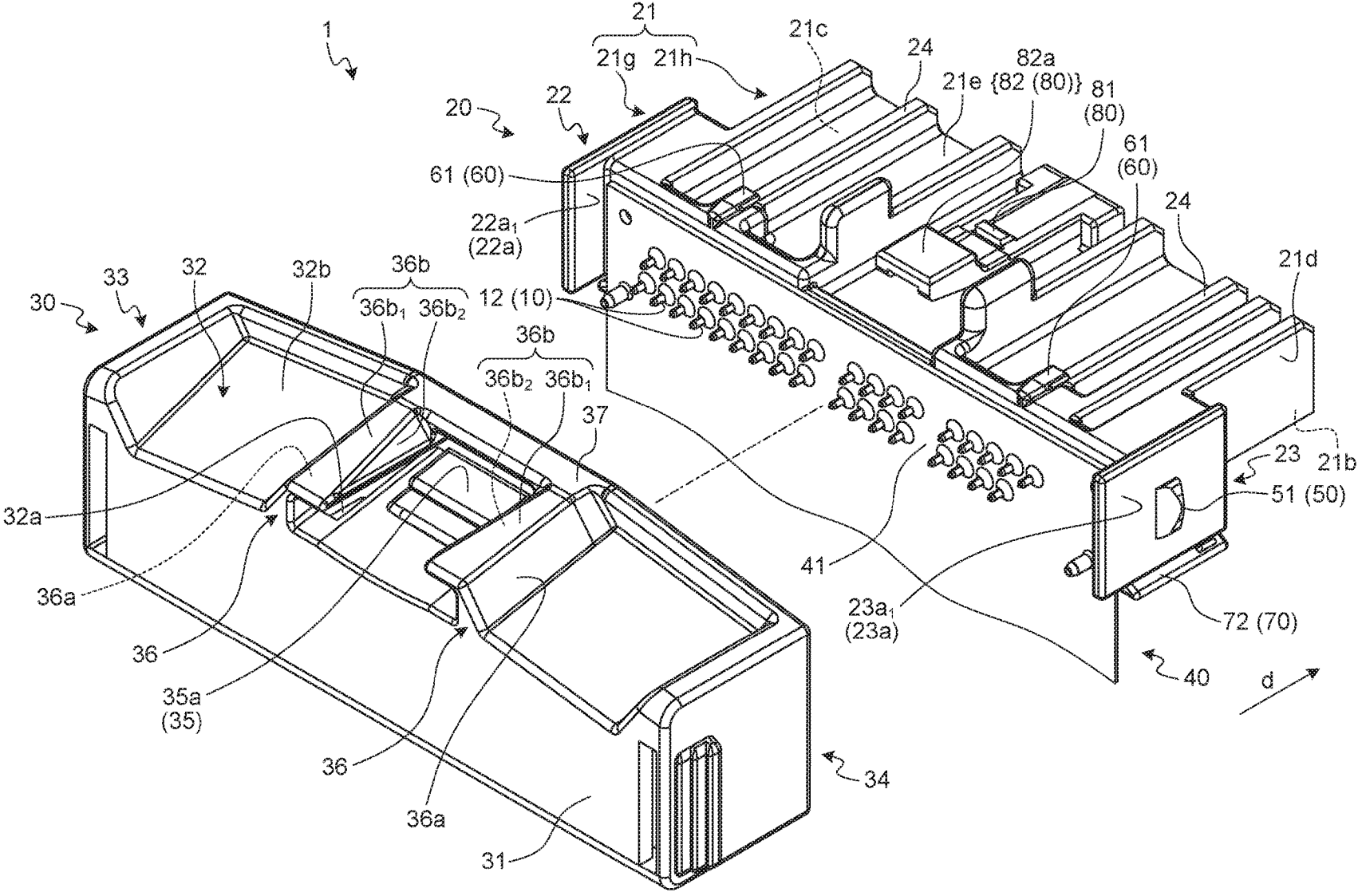
FIG. 4 is an exploded perspective view of the connector before cover connection when viewed at a different angle.
Figure 5:
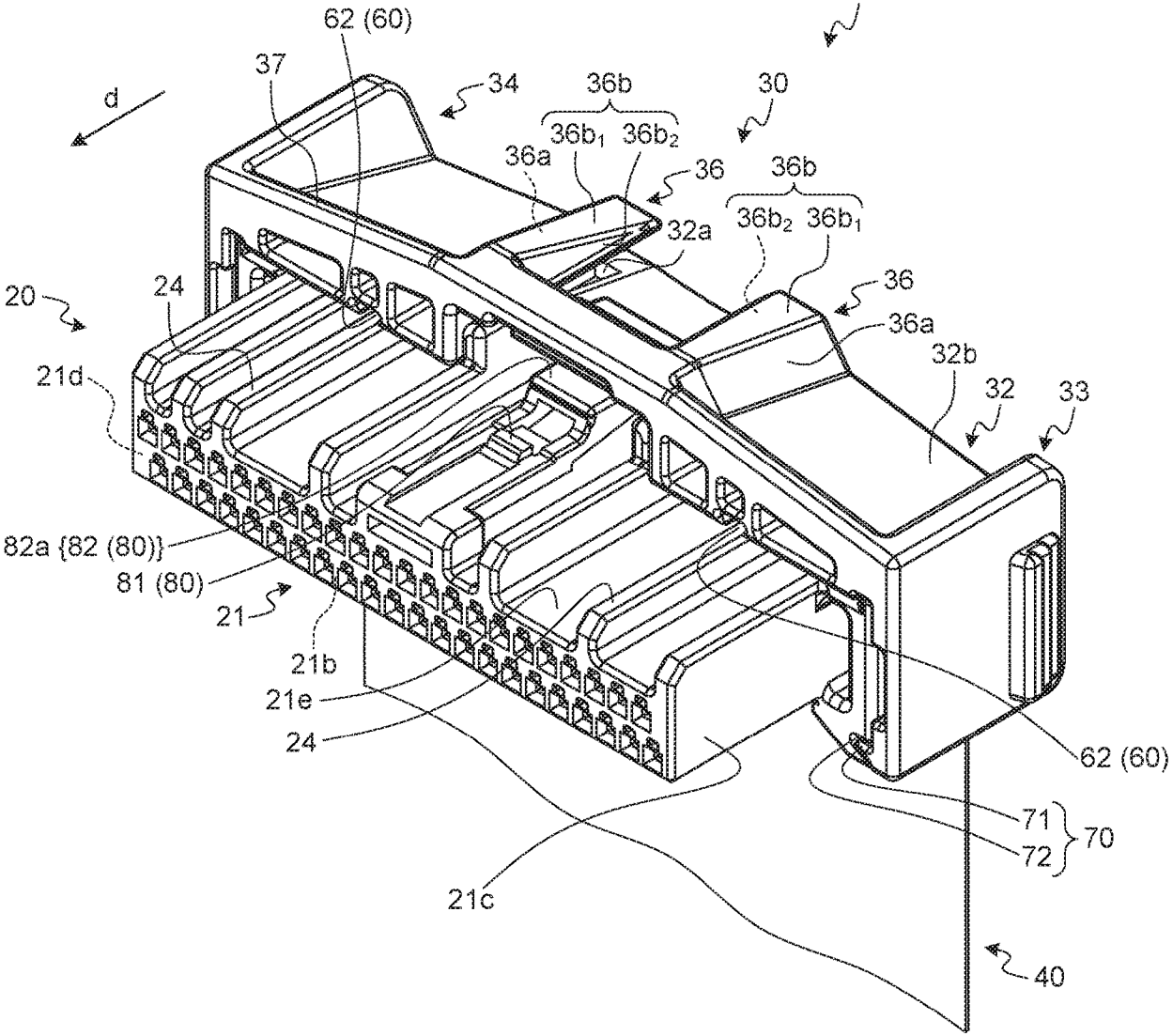
FIG. 5 is a perspective view illustrating the connector of the embodiment.

The housing body 21 includes a third outer wall surface 21*c* and a fourth outer wall surface 21*d* that are disposed orthogonal to the first outer wall surface 21*a* and the second outer wall surface 21*b* (FIGS. 1 to 3). The housing 20 covers and hides the electrical connection part 12 of each terminal clasp 10 and the side 41 (in other words, the electrical connection part of each conductor) of the conductive component 40 from the third outer wall surface 21*c* side and the fourth outer wall surface 21*d* side, thereby protecting these components. For this, the housing 20 includes a first protection body 22 disposed opposite to and coupled with the third outer wall surface 21*c* at an interval, and a second protection body 23 disposed opposite to and coupled with the fourth outer wall surface 21*d* at an interval and protruding further than the first outer wall surface 21*a* (FIGS. 1 to 4 and 6).

The first protection body 22 of this example includes a flat plate part 22*a* having a rectangular flat plate shape, and the flat plane of the flat plate part 22*a* is disposed opposite to the third outer wall surface 21*c* at an interval (FIGS. 1 to 4 and 6). In the first protection body 22, the flat plate part 22*a* includes a protrusion part 22*a*, protruding further than the first outer wall surface 21*a*, and the protrusion part 22*a*, covers and hides the electrical connection part 12 of each terminal clasp 10 and the side 41 of the conductive component 40 from the third outer wall surface 21*c* side (FIGS. 1 to 4). The second protection body 23 of this example includes a flat plate part 23*a* having a rectangular flat plate shape, and the flat plane of the flat plate part 23*a* is disposed opposite to the fourth outer wall surface 21*d* at an interval (FIGS. 1 to 4 and 6). In the second protection body 23, the flat plate part 23*a* includes a protrusion part $\mathbf{23}a_1$ protruding further than the first outer wall surface 21*a*, and the protrusion part $\mathbf{23}a_1$ covers and hides the electrical connection part 12 of each terminal clasp 10 and the side 41 of the conductive component 40 from the fourth outer wall surface 21*d* side (FIGS. 1 to 4).

In the housing 20, a plurality of reinforcement ribs 24 are provided to the housing body 21 (FIGS. 3 to 6). The reinforcement ribs 24 protrude on a fifth outer wall surface 21*e* of the housing body 21. The fifth outer wall surface 21*e* is an outer wall surface of the housing body 21, which is disposed orthogonal to the first outer wall surface 21*a* and disposed on a side opposite to the second outer wall surface 21*b*.

The housing body 21 is roughly divided into a base part 21*g* and a fitting connection part 21*h* in the fitting connection direction d (FIGS. 1 to 4). In the housing 20 of this example, the base part 21*g* is coupled with the first protection body 22 and the second protection body 23. The fitting connection part 21*h* is fitted and connected to a counterpart fitting connection part (not illustrated) of the counterpart housing in the fitting connection direction d. The fitting connection part 21*h* of this example is fitted inside the counterpart fitting connection part.

The cover 30 is formed of an insulating material such as synthesis resin. For example, the conductive part covered by the cover 30 is part of an electrical wire as the conductive component 40, which extends from the housing body 21, or is the electrical connection part 12 protruding out of the housing body 21 and the side 41 of the flexible flat conductive component as the conductive component 40. In this example, the conductive part covered by the cover 30 is the electrical connection part 12 of each terminal clasp 10 and the side 41 of the conductive component 40 (electrical connection part of each conductor). The cover 30 covers and hides, with the first wall 31 and a second wall 32, the electrical connection part 12 of each terminal clasp 10 and the side 41 of the conductive component 40, thereby protecting these components (FIGS. 1 to 4 and 7). The first wall 31 is disposed opposite to the first outer wall surface 21*a* at an interval, thereby covering and hiding the electrical connection part 12 of each terminal clasp 10 and the side 41 of the conductive component 40. The second wall 32 is provided continuously with the first wall 31 and disposed opposite to the fifth outer wall surface 21*e* at an interval, thereby covering and hiding the electrical connection part 12 of each terminal clasp 10 and the side 41 of the conductive component 40 from the fifth outer wall surface 21*e* side.

In addition, the cover 30 includes a third wall 33 disposed opposite to the first protection body 22 of the housing 20 to cover the first protection body 22 from outside, and a fourth wall 34 disposed opposite to the second protection body 23 of the housing 20 to cover the second protection body 23 from outside (FIGS. 1 to 4 and 7). The third wall 33 and the fourth wall 34 of this example are formed in rectangular flat plate shapes and flexible.

The cover 30 of the present embodiment is formed to cover the base part 21*g* of the housing body 21 from the first outer wall surface 21*a* side, the third outer wall surface 21*c* side, the fourth outer wall surface 21*d* side, and the fifth outer wall surface 21*e* side.

The housing 20 and the cover 30 are inserted and connected with each other in the direction orthogonal to the first outer wall surface 21*a*. In this example, the housing 20 is inserted and connected with the cover 30 from the first outer wall surface 21*a* side in a direction opposite to the fitting connection direction d. When the insertion and connection of the housing 20 and the cover 30 are performed up to a connection completed position, the first outer wall surface 21*a* and the first wall 31 are positioned opposite to each other, the fifth outer wall surface 21*e* and the second wall 32 are positioned opposite to each other, the first protection body 22 and the third wall 33 are positioned opposite to each other, and the second protection body 23 and the fourth wall 34 are positioned opposite to each other.

A locking structure (hereinafter referred to as "first locking structure") 50 configured to lock motion of the housing and the cover opposite to the connection direction at the connection completed position is provided between the housing 20 and the cover 30 (FIGS. 1 to 3, 7, and 8). The first locking structure 50 includes a first lock body 51 provided to the housing 20, and a second lock body 52 provided to the cover 30 (FIGS. 1, 3, 7, and 8). The first lock body 51 and the second lock body 52 are disposed opposite to each other to lock motion of the housing 20 and the cover 30 opposite to the connection direction when the housing 20 and the cover 30 are at the connection completed position.

In the connector 1 of the present embodiment, the first locking structures 50 are provided at two places: between the first protection body 22 and the third wall 33 and between the second protection body 23 and the fourth wall 34. In this example, each first lock body 51 is formed as a lock protrusion, and each second lock body 52 is formed as a lock wall that is engaged with the first lock body 51. The first lock body 51 protrudes outward from the outer wall surface of the corresponding one of the first protection body 22 and the second protection body 23. The second lock body 52 is formed at the inner wall surface of the corresponding one of the third wall 33 and the fourth wall 34. The first locking structures 50 at the two places are provided so that the first lock bodies 51 thereof protrude in directions opposite to each other.

Figure 6:
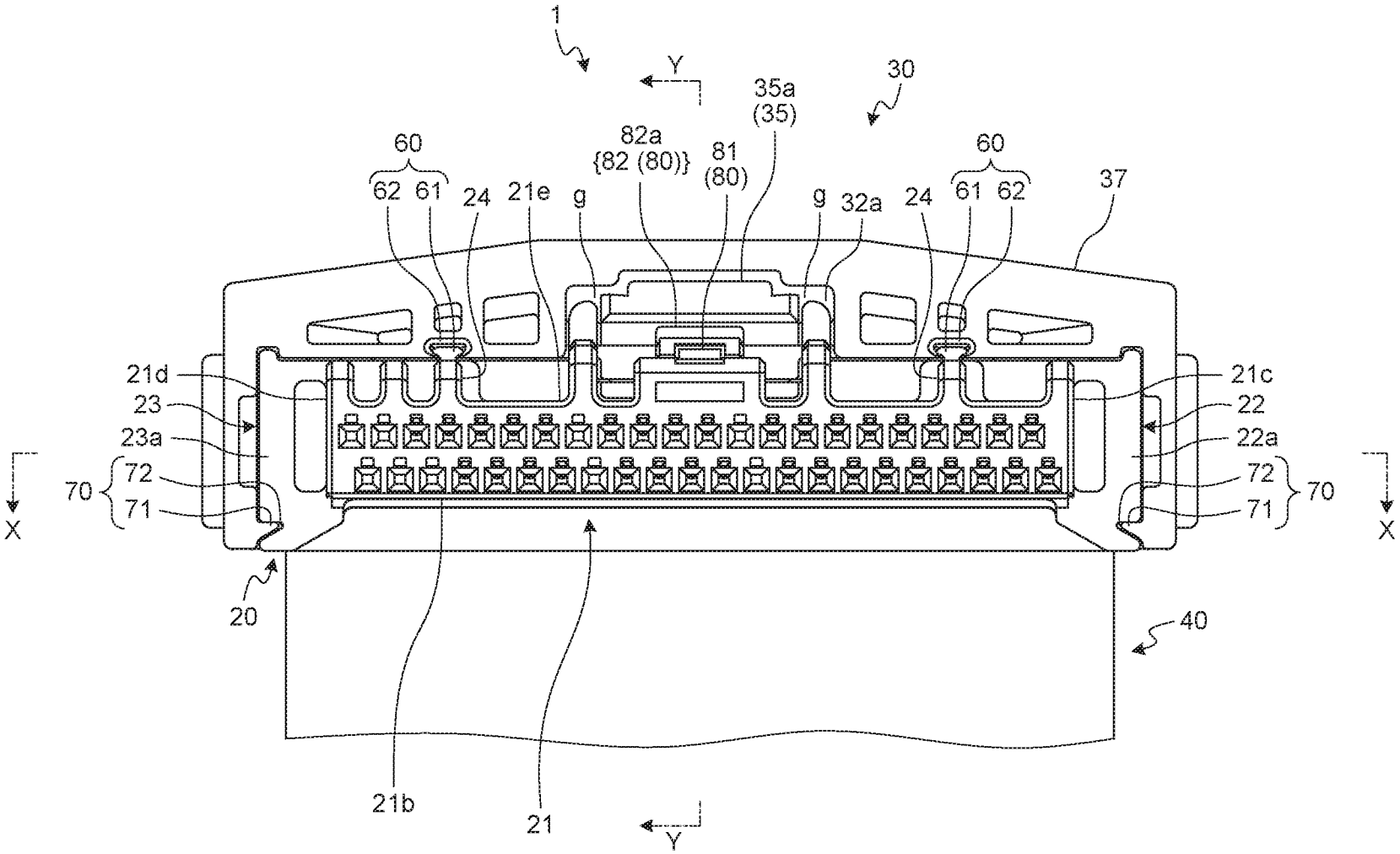
FIG. 6 is a front view illustrating the connector of the embodiment.

In addition, a locking structure (hereinafter referred to as "second locking structure") 60 configured to lock motion of the housing 20 and the cover 30 in a separation direction among directions orthogonal to the connection direction at the connection completed position is provided between the housing 20 and the cover 30 (FIGS. 3 to 6). The second locking structure 60 includes a first lock body 61 provided to the housing 20, and a second lock body 62 provided to the cover 30 (FIGS. 3 and 6).

In the second locking structure 60 of this example, the first lock body 61 as a lock protrusion protrudes from the reinforcement ribs 24, and the second lock body 62 as a lock groove that is engaged with the first lock body 61 is formed at the second wall 32 of the cover 30. The first lock body 61 and the second lock body 62 each have a stereoscopic shape having a substantially trapezoid section orthogonal to the connection direction of the housing 20 and the cover 30 and extending in the connection direction. In each of the first lock body 61 and the second lock body 62, the upper base of the substantially trapezoid orthogonal section is positioned on the fifth outer wall surface 21*e* side. With this configuration, the first lock body 61 and the second lock body 62 lock motion of the housing 20 and the cover 30 in the separation direction when the housing 20 and the cover 30 are at the connection completed position. The first lock body 61 and the second lock body 62 also serve as a guiding structure for connecting the housing 20 and the cover 30 through insertion. The connector 1 of the present embodiment includes the second locking structures 60 at two places.

In addition, a guiding structure 70 configured to guide the housing 20 and the cover 30 in the connection direction is provided between the housing 20 and the cover 30 (FIGS. 1 to 6). The guiding structure 70 includes a wedge guiding protrusion 71 that is a protrusion provided to one of the housing 20 and the cover 30, has a wedge-shaped section orthogonal to the connection direction, and extends in the connection direction, and a wedge guiding groove 72 that is a groove provided to the other of the housing 20 and the cover 30, has a wedge-shaped section orthogonal to the connection direction, and extends in the connection direction to guide and be guided by the wedge guiding protrusion 71 being inserted in the connection direction (FIGS. 1, 3, 5, and 6).

The guiding structures 70 are provided at two places between the housing 20 and the cover 30 of this example. The guiding structures 70 at the two places are provided so that the wedge guiding protrusions 71 protrude in directions opposite to each other. The wedge guiding protrusions 71 of this example are provided to the third wall 33 and the fourth wall 34 of the cover 30. In this example, the wedge guiding protrusions 71 are disposed opposite to each other and formed at sides of the rectangular third wall 33 and the rectangular fourth wall 34. The wedge guiding grooves 72 of this example are provided to the first protection body 22 and the second protection body 23 of the housing 20. The wedge guiding groove 72 of the first protection body 22 is disposed adjacent to the flat plate part 22*a* in the flat plane direction of the flat plate part 22*a*. The wedge guiding groove 72 of the second protection body 23 is disposed adjacent to the flat plate part 23*a* in the flat plane direction of the flat plate part 23*a*.

In the connector 1 thus configured, the fitting connection part 21*h* of the housing body 21 is fitted and connected to the counterpart fitting connection part of the counterpart housing as described above. A holding structure 80 for holding the fitting connection is provided between the housing 20 and the counterpart housing (FIGS. 1 to 6 and 9). The housing 20 includes, as components of the holding structure 80, a lock body 81 that is lockable to a counterpart lock body 501 (FIG. 9) of the counterpart housing so that the fitting connection with the counterpart housing is not canceled, and a lock cancellation arm 82 that deforms with application of lock cancellation force on a point-of-effort part 82*a* and cancels a state in which the lock body 81 is lockable to the counterpart lock body 501 (FIGS. 1 to 6 and 9).

In this example, the lock body 81 is formed as a lock protrusion, and the counterpart lock body 501 is formed as a lock wall that is engaged with the lock body 81. The lock cancellation arm 82 of this example has a cantilever shape that allows elastic deformation pivoted at a fixed end. In this example, the fixed end is coupled with the fitting connection part 21*h* side of the fifth outer wall surface 21*e* and extends to the base part 21*g* side of the fifth outer wall surface 21*e* in a direction opposite to the fitting connection direction d. The point-of-effort part 82*a* is a free end of the lock cancellation arm 82 on the base part 21*g* side. In this example, the point-of-effort part 82*a* is formed in a rectangular flat plate shape. The lock cancellation arm 82 has a wall surface disposed opposite to the fifth outer wall surface 21*e* at an interval. In the lock cancellation arm 82, the lock body 81 is provided as a protrusion on a wall surface opposite to the wall surface between the fixed end and the free end. In the lock cancellation arm 82 formed in this manner, lock cancellation force toward the fifth outer wall surface 21*e* is applied to the point-of-effort part 82*a* when canceling a state in which the lock body 81 and the counterpart lock body 501 are lockable to each other. In the holding structure 80, the lock cancellation force deforms the lock cancellation arm 82, and the lock body 81 is displaced to the fifth outer wall surface 21*e* side along with the deformation of the lock cancellation arm 82, which cancels the state in which the lock body 81 and the counterpart lock body 501 are lockable to each other.

In the connector 1 of the present embodiment, the cover 30 covers the base part 21*g* of the housing body 21 from the first outer wall surface 21*a* side, the third outer wall surface 21*c* side, the fourth outer wall surface 21*d* side, and the fifth outer wall surface 21*e* side as described above. Thus, the cover 30 covers the housing 20 up to the position of the point-of-effort part 82*a* of the lock cancellation arm 82 in the fitting connection direction d. The fifth outer wall surface 21*e* side of the base part 21*g* is covered by the second wall 32 of the cover 30. In the connector 1, lock cancellation force cannot be applied to the point-of-effort part 82*a* when the second wall 32 covers the point-of-effort part 82*a* from outside. Thus, an exposure part 32*a* is formed at the second wall 32 to expose the point-of-effort part 82*a* (FIGS. 1 to 7 and 9).

The cover 30 includes an elastically deformable lock cancellation operation body 35 for applying lock cancellation force to the point-of-effort part 82*a* exposed outside through the exposure part 32*a* (FIGS. 1 to 7 and 9). The lock cancellation operation body 35 includes an operation part 35*a* capable of receiving a press movement operation, and applies lock cancellation force to the point-of-effort part 82*a* through deformation along with the press movement operation. The lock cancellation operation body 35 is formed to block the exposure part 32*a* to an extent that deformation along with the press movement operation is possible.

The lock cancellation operation body 35 of this example has a cantilever shape that allows elastic deformation pivoted at a fixed end. The fixed end is coupled with the first wall 31, and the lock cancellation operation body 35 extends to a position where the lock cancellation operation body 35 covers the point-of-effort part 82*a* from outside in the fitting connection direction d. The lock cancellation operation body 35 of this example is formed in a piece shape having a wall surface on a side disposed opposite to the point-of-effort part 82*a*, and a wall surface on a side opposite to the wall surface, and the wall surface on the opposite side is used as the operation part 35*a*. The lock cancellation operation body 35 of this example is disposed at the exposure part 32*a*. In the lock cancellation operation body 35 formed in this manner, when canceling a state in which the lock body 81 and the counterpart lock body 501 are lockable to each other, lock cancellation force toward the fifth outer wall surface 21*e* is applied from the free end side to the point-of-effort part 82*a* by performing press movement operation on the operation part 35*a* toward the point-of-effort part 82*a* side. Accordingly, the state in which the lock body 81 and the counterpart lock body 501 are lockable to each other is canceled in the holding structure 80 as described above.

The connector 1 of the present embodiment includes the cover 30 that covers the point-of-effort part 82*a* of the lock cancellation arm 82, and a lock cancellation operation function (the lock cancellation operation body 35) of the holding structure 80 is provided to the cover 30. With this configuration, for example, when canceling the state in which the lock body 81 and the counterpart lock body 501 are lockable to each other, it is unnecessary to perform work of, for example, temporarily removing the cover 30 from the housing 20, and thus the connector 1 can improve the operability of removal from the counterpart connector.

In the connector 1 of the present embodiment, the exposure part 32*a* is provided to the cover 30, and the lock cancellation operation body 35 is provided to the exposure part 32*a*, thereby providing the lock cancellation operation function (lock cancellation operation body 35) of the holding structure 80 to the cover 30. With this configuration, the connector 1 can improve the operability of removal from the counterpart connector while avoiding increase in its size.

In the connector 1 of the present embodiment, the exposure part 32*a* is blocked by the lock cancellation operation body 35 to an extent that deformation along with a press movement operation is possible, and thus it is possible to prevent ingress of water to the housing body 21 inside from outside of the cover 30 through the exposure part 32*a*. Accordingly, the connector 1 can prevent ingress of water into the gap between the fitting connection part 21*h* and the counterpart fitting connection part and transfer of water to the terminal clasp 10 and the counterpart terminal clasp. Thus, the connector 1 can reduce waterproof property degradation due to provision of the lock cancellation operation function (lock cancellation operation body 35) of the holding structure 80 to the cover 30. As a result, the connector 1 can improve the operability of removal from the counterpart connector and can reduce waterproof property degradation.

Figure 9:
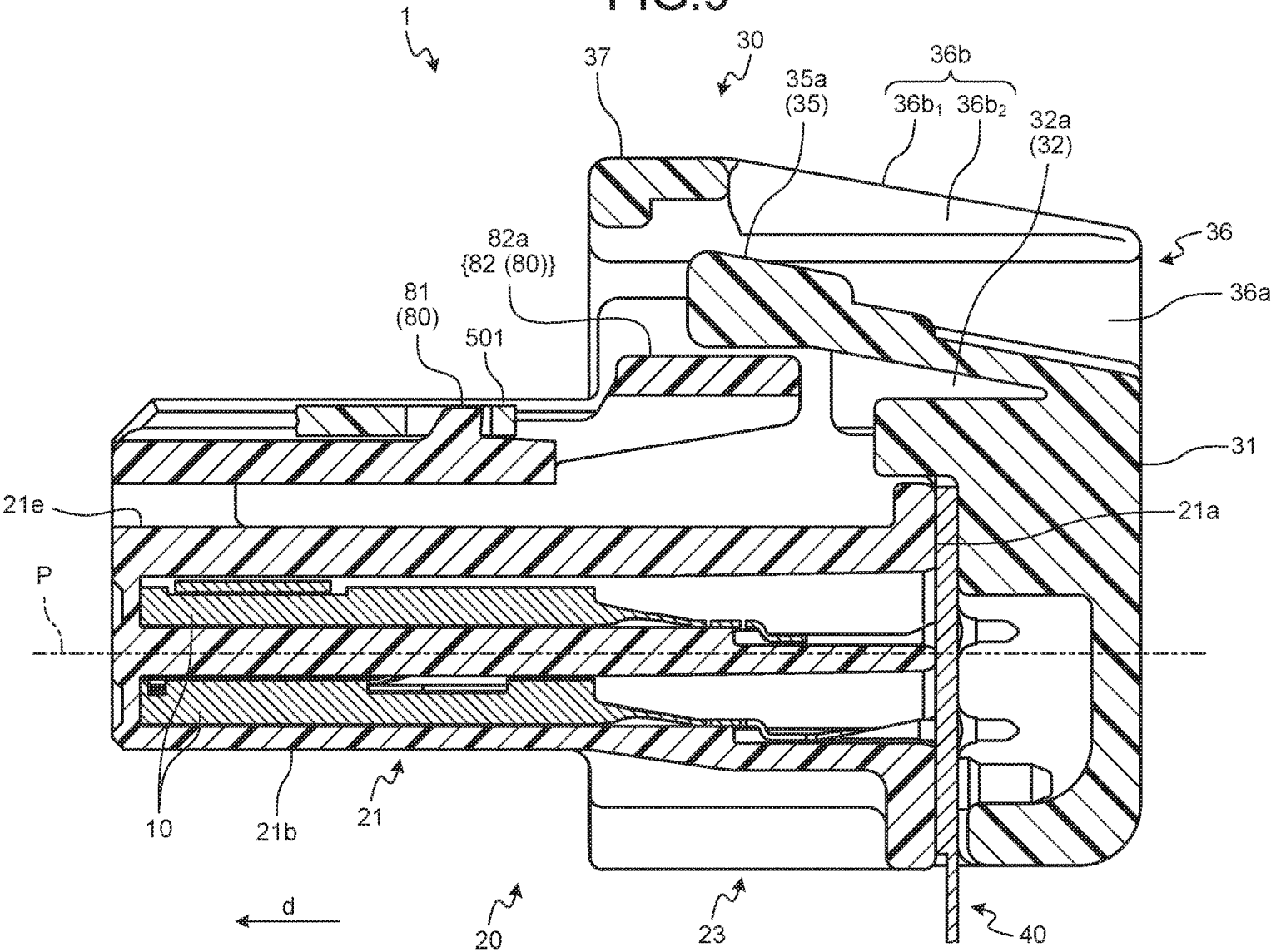
FIG. 9 is a cross-sectional view taken along line Y-Y in FIG. 6.

It is possible to further enhance the effect of reducing waterproof property degradation of the connector 1 of the present embodiment by forming the operation part 35*a* of the lock cancellation operation body 35 as follows. A virtual plane P aligned with the fitting connection direction d and orthogonal to the direction in which lock cancellation force is applied is set inside the housing 20 (FIG. 9). The operation part 35*a* is formed in a tilt shape in which the shortest distance between the virtual plane P and a point positioned on the operation part 35*a* along the fitting connection direction d increases as the point moves further in the fitting connection direction d (FIG. 9). For example, when the connector 1 is installed so that the direction in which lock cancellation force is applied is downward in the vertical direction, water on the operation part 35*a* flows to the first wall 31 side along the tilt shape, which can prevent ingress of the water to the fitting connection part 21*h* side. Thus, the connector 1 can further enhance the effect of reducing waterproof property degradation.

In the connector 1, the lock cancellation operation body 35 blocks the exposure part 32*a* to an extent that deformation along with a press movement operation is possible, but there exists a gap between the lock cancellation operation body 35 and the periphery of the exposure part 32*a*. Thus, the cover 30 is provided with a shielding body 36 that covers the gap from the operation part 35*a* side (FIGS. 1 to 5, 7, and 9).

Figure 7:
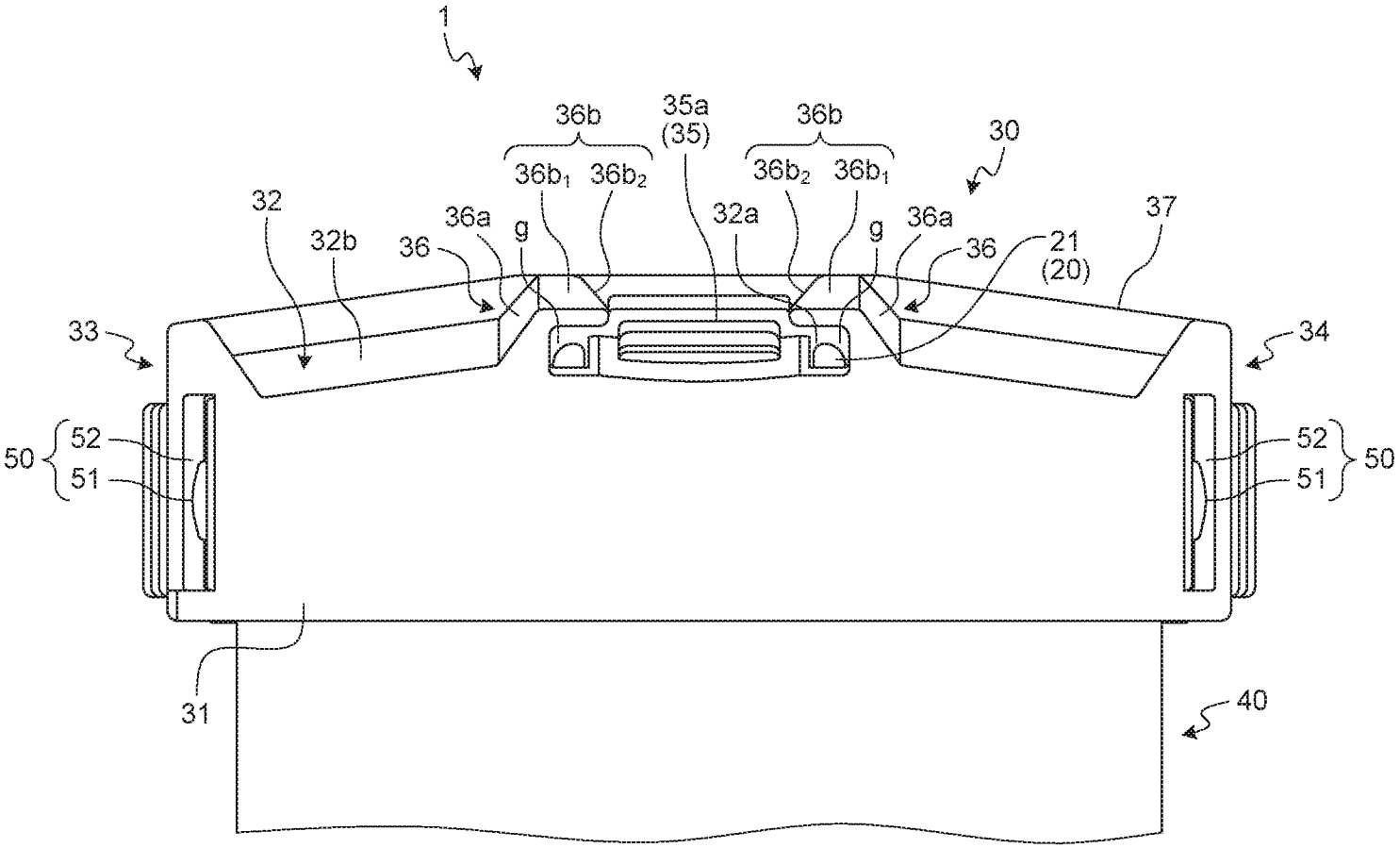
FIG. 7 is a back view illustrating the connector of the embodiment.
Figure 8:
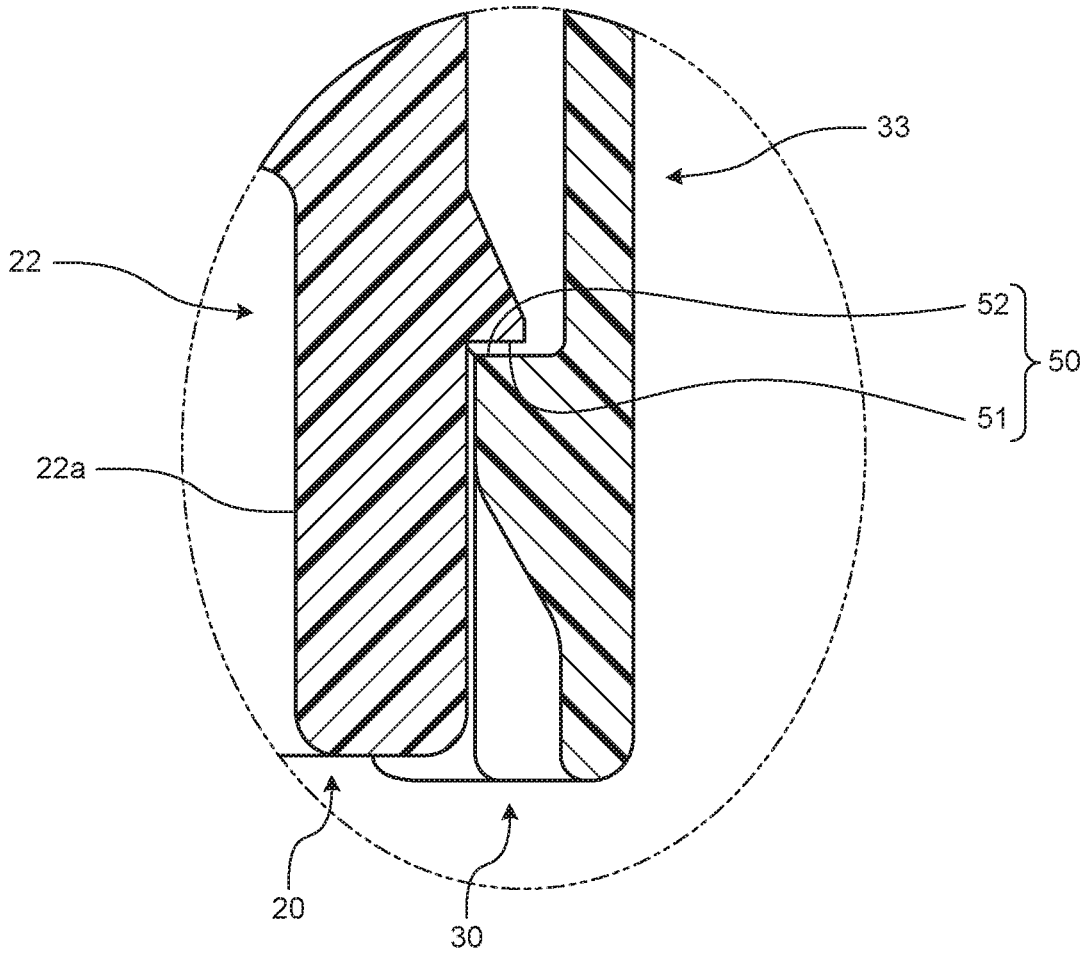
FIG. 8 is a partially enlarged diagram of a section taken along line X-X in FIG. 6.

In the connector 1 of this example, to allow deformation of the lock cancellation operation body 35 in a cantilever shape, a gap g is provided between the lock cancellation operation body 35 and the third outer wall surface 21*c* side of the periphery of the exposure part 32*a*, and another gap g is provided between the lock cancellation operation body 35 and the fourth outer wall surface 21*d* side of the periphery of the exposure part 32*a* (FIGS. 6 and 7). With this configuration, the cover 30 of this example includes the shielding body 36 for each gap g. In this example, one of the shielding bodies 36 is erected on the third outer wall surface 21*c* side of the periphery of the exposure part 32*a*, and the other shielding body 36 is erected on the fourth outer wall surface 21*d* side of the periphery of the exposure part 32*a*. Each shielding body 36 includes a first wall part 36*a* erected outward from the periphery of the exposure part 32*a*, and a second wall part 36*b* bent from an end part of the first wall part 36*a* on the erection direction side to cover the gap g (FIGS. 3, 4, 5, 7, and 9).

The second wall part 36*b* includes a first outer wall surface $\mathbf{36}b_1$ tilted in a direction same as the direction in which the operation part 35*a* is tilted (FIGS. 3, 4, 5, 7, and 9). Accordingly, when the connector 1 is installed so that the direction in which lock cancellation force is applied is downward in the vertical direction as described above, water on the first outer wall surface $\mathbf{36}b_1$ flows to the first wall 31 side along the tilt shape of the first outer wall surface $\mathbf{36}b_1$, which can prevent ingress of the water to the fitting connection part 21*h* side. Thus, the connector 1 can further enhance the effect of reducing waterproof property degradation.

The second wall part 36*b* also includes a second outer wall surface $\mathbf{36}b_2$ tilted toward the operation part 35*a* from the first outer wall surface 36*b*, (FIGS. 3, 4, 5, 7, and 9). Accordingly, when the connector 1 is installed so that the direction in which lock cancellation force is applied is downward in the vertical direction as described above, water on the second outer wall surface $\mathbf{36}b_2$ flows to the operation part 35*a* along the tilt shape of the second outer wall surface $\mathbf{36}b_2$, and then the water on the operation part 35*a* flows to the first wall 31 side, which can prevent ingress of the water to the fitting connection part 21*h* side. Thus, the connector 1 can further enhance the effect of reducing waterproof property degradation.

In the connector 1, a standing wall 37 is provided at an end part of the second wall 32 on the fitting connection direction d side in the cover 30 and erected from the end part in a direction opposite to the direction in which lock cancellation force is applied (FIGS. 1 to 7 and 9). Accordingly, in the connector 1, water on an outer wall surface 32*b* of the second wall 32 can be stopped by the standing wall 37, which can prevent ingress of the water to the fitting connection part 21*h* side (FIGS. 1 to 5 and 7). Thus, the connector 1 can further enhance the effect of reducing waterproof property degradation.

In addition, the standing wall 37 couples end parts of the respective shielding bodies 36 on the fitting connection direction d side and covers, from outside, the free end side of the lock cancellation operation body 35 between the end parts of the shielding bodies 36. Accordingly, when the connector 1 is installed so that the direction in which lock cancellation force is applied is downward in the vertical direction as described above, the standing wall 37 between the end parts of the shielding bodies 36 can prevent ingress of water from the vicinity of the free end of the lock cancellation operation body 35 to the housing body 21 side. In this manner, the connector 1 can prevent ingress of water to the fitting connection part 21*h* side, and thus can further enhance the effect of reducing waterproof property degradation.

The operation part 35*a* of the lock cancellation operation body 35 is desirably formed in a shape that allows reception of a press movement operation by a finger. In this example, the operation part 35*a* is formed in a shape that allows reception of a press movement operation by a finger, and a region surrounded by the shielding bodies 36 and the standing wall 37 between the end parts of the shielding bodies 36 is formed in such a size that the finger can reach the operation part 35*a*. Accordingly, in the connector 1, the state in which the lock body 81 and the counterpart lock body 501 are lockable to each other can be manually and easily canceled without using a tool or the like for the cancellation.

In the cover 30, the outer wall surface 32*b* of the second wall 32 is tilted in a direction same as the direction in which the operation part 35*a* is tilted. Accordingly, when the connector 1 is installed so that the direction in which lock cancellation force is applied is downward in the vertical direction as described above, water on the outer wall surface 32*b* flows to the first wall 31 side along the tilt shape of the outer wall surface 32*b*, which can prevent ingress of the water to the fitting connection part 21*h* side. Thus, the connector 1 can further enhance the effect of reducing waterproof property degradation.

As described above, the connector 1 of the present embodiment can reduce waterproof property degradation.

In a connector according to the present embodiment, the lock cancellation operation body blocks the exposure part to an extent that deformation with a press movement operation is possible, which can prevent ingress of water to the housing side inside from outside of the cover through the exposure part. Thus, the connector can prevent ingress of water into a gap between the fitting connection part of the housing and a counterpart fitting connection part, thereby preventing transfer of the water to the terminal clasp and a counterpart terminal clasp. Accordingly, the connector can reduce waterproof property degradation due to provision of the lock cancellation operation body to the cover.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal clasp;

a housing that stores the terminal clasp and that is fitted and connected to a counterpart housing of a counterpart connector in a fitting connection direction; and a cover that covers, from outside, at least part of the housing and a conductive part protruding from the housing, wherein the housing includes a lock body that is lockable to a counterpart lock body of the counterpart housing so that fitting connection with the counterpart housing is not canceled, and a lock cancellation arm that deforms with application of lock cancellation force on a point-of-effort part of the lock cancellation arm and cancels a state in which the lock body is lockable to the counterpart lock body, and the cover includes a wall that covers the housing up to a position of the point-of-effort part in the fitting connection direction, an exposure part formed at the wall to expose the point-of-effort part, and a lock cancellation operation body that is elastically deformable, includes an operation part capable of receiving a press movement operation, blocks the exposure part to an extent that deformation along with the press movement operation is possible, and applies the lock cancellation force to the point-of-effort part through deformation along with the press movement operation.

2. The connector according to claim 1, wherein the housing includes therein a virtual plane aligned with the fitting connection direction and orthogonal to a direction in which the lock cancellation force is applied, and the operation part is formed in a tilt shape in which the shortest distance between the virtual plane and a point positioned on the operation part along the fitting connection direction increases as the point moves further in the fitting connection direction.

3. The connector according to claim 1, wherein the cover includes a shielding body that covers a gap between the lock cancellation operation body and the periphery of the exposure part from the operation part side.

4. The connector according to claim 2, wherein the cover includes a shielding body that covers a gap between the lock cancellation operation body and the periphery of the exposure part from the operation part side.

5. The connector according to claim 1, wherein the housing includes therein a virtual plane aligned with the fitting connection direction and orthogonal to a direction in which the lock cancellation force is applied, the operation part is formed in a tilt shape in which the shortest distance between the virtual plane and a point positioned on the operation part along the fitting connection direction increases as the point moves further in the fitting connection direction, the cover includes a shielding body that covers a gap between the lock cancellation operation body and the exposure part from the operation part side, and the shielding body has a first outer wall surface tilted in a direction same as a direction in which the operation part is tilted.

6. The connector according to claim 5, wherein the shielding body has a second outer wall surface tilted toward the operation part from the first outer wall surface.

* * * * *